US005845352A

United States Patent [19]

Matsler et al.

[11] Patent Number: 5,845,352

[45] Date of Patent: Dec. 8, 1998

[54] FOAM-AIR HYBRID CUSHION AND METHOD OF MAKING SAME

[75] Inventors: Winfield R. Matsler; Kurt Graebe, both of Belleville, Ill.

[73] Assignee: Roho, Inc., Belleville, Ill.

[21] Appl. No.: 679,267

[22] Filed: Jul. 12, 1996

[51] Int. Cl.[6] ..... A47C 27/10; A47C 7/02; A47G 9/00

[52] U.S. Cl. ..... 5/654; 5/655.3; 5/655.9; 297/452.41; 297/452.42; 297/452.47

[58] Field of Search ..... 5/653, 654, 655.9, 5/657.5, 657, 655.3, 699, 724; 297/452.25, 452.41, 452.42, 452.47

[56] References Cited

U.S. PATENT DOCUMENTS

| | | | |
|---|---|---|---|
| 2,672,183 | 3/1954 | Forsyth . | |
| 2,691,179 | 10/1954 | Kann . | |
| 2,748,399 | 6/1956 | Rockoff . | |
| 2,819,712 | 1/1958 | Morrison . | |
| 3,008,465 | 11/1961 | Gal . | |
| 3,982,786 | 9/1976 | Burgin et al. . | |
| 4,186,734 | 2/1980 | Stratton | 601/148 |
| 4,541,136 | 9/1985 | Graebe . | |
| 4,660,238 | 4/1987 | Jay . | |
| 4,698,864 | 10/1987 | Graebe . | |
| 4,726,624 | 2/1988 | Jay . | |
| 4,753,480 | 6/1988 | Morell . | |
| 4,761,843 | 8/1988 | Jay . | |
| 4,796,948 | 1/1989 | Paul et al. . | |
| 4,803,744 | 2/1989 | Peck et al. . | |
| 4,856,844 | 8/1989 | Isono . | |
| 4,930,171 | 6/1990 | Frantz | 5/635 X |
| 4,953,913 | 9/1990 | Graebe . | |
| 4,965,901 | 10/1990 | Normand . | |
| 4,982,466 | 1/1991 | Higgins et al. . | |
| 5,052,068 | 10/1991 | Graebe . | |
| 5,111,544 | 5/1992 | Graebe . | |
| 5,233,974 | 8/1993 | Senoue et al. . | |
| 5,369,828 | 12/1994 | Graebe . | |
| 5,499,413 | 3/1996 | Van Hekken . | |
| 5,529,377 | 6/1996 | Miller . | |
| 5,551,107 | 9/1996 | Graebe | 5/922 X |
| 5,573,305 | 11/1996 | Storch | 297/452.58 X |

*Primary Examiner*—Michael F. Trettel
*Attorney, Agent, or Firm*—Polster, Lieder, Woodruff & Lucchesi, L.C.

[57] ABSTRACT

A composite foam base air cell module cushion having a water resistant skin, a contoured foam base designed to relieve pressure on the trochanters and the ischia and an air cell module having two sets of air cells, each partially filled, positioned inside the foam base in a chamber beneath the rear of the base. The skin is of two layer construction with a two-way stretch outer layer and a water impervious inner layer. The bottom of the base is covered with a water impervious sheet and the edges are secured to the edges of the top skin covering. The air cell is made by placing the preformed top into molds smaller in depth than the air cells to partially collapse the air cells before a base is applied to the top to close the open ends of the air cells and trap air therein.

23 Claims, 5 Drawing Sheets

FOAM-AIR HYBRID CUSHION AND METHOD OF MAKING SAME

BACKGROUND OF THE INVENTION

This invention relates in general to cushioning devices and, more particularly to wheelchair or other seat or chair cushions. This invention includes a shaped soft foam base which has a moisture resistant top skin formed integrally therewith and a moisture impervious bottom skin adhered to the bottom of the foam base. An air cell module having two separate sets of interconnected partially filled air cells is loosely positioned in a chamber formed in the foam base beneath the buttocks of the user to provide support for the user and prevent bottoming out of the user.

The invention also involves the process of making the air cell module with partially filled air cells so that the sealed module is useful at a variety of altitudes, barometric pressures, and temperatures.

Those who must spend extended time in wheelchairs run the risk of tissue breakdown and the development of pressure sores, which are extremely dangerous and difficult to cure. These pressure sores or decubitus ulcers, typically form in areas where bony prominences exist, such as the ischia, heels, elbows, ears and shoulders. Typically, when sitting much of the individual's weight concentrates in the regions of the ischia, that is at the bony prominences of the buttocks and unless frequent movement occurs, the flow of blood to the skin tissue in these regions decreases to the point that the tissue breaks down. This problem is well known and many forms of cushions are especially designed for wheelchairs for reducing the concentration of weight in the region of the ischia, and these cushions generally seek to distribute the user's weight more uniformly over a larger area of the buttocks.

Another area where problems occur is in the trochanter area and both cushions and bases for the cushions are shaped so that pressure is relieved on the ischia and the trochanters. Still another problem with wheelchair type cushions is stabilization of the user so that he has a feeling of security when sitting in the wheelchair.

A number of patents show cellular cushions which comprise an array of closely spaced air cells which project upwardly from a common base and are interconnected. These cushions combine the most uniform distribution of weight and thus provide the greatest protection from the occurrence of pressure sores. Since the air cells communicate with each other, all exist at the same internal pressure and each air cell exerts essentially the same restoring force against the buttocks, irrespective of the extent to which it is deflected. U. S. Pat. No. 4,541,136 shows a cellular cushion currently manufactured and sold by Roho, Inc. of Belleville, Ill. for use on wheelchairs.

The stability problem has been attacked by the use of shaped bases such as shown in Graebe U.S. Pat. No. 4,953,913 and Jay U.S. Pat. No. 4,726,624. These bases are generally used in conjunction with cushions and Graebe U.S. Pat. No. 4,953,913 has been used in conjunction with a cellular cushion and a fabric cover. The stability problem also has been addressed in the cellular cushion field by the use of zoned areas of inflation as shown in Graebe U.S. Pat. No. 4,698,864 which shows a zoned cellular cushion with cells of varying height and Graebe U.S. Pat. No. 5,052,068 which shows another form of zoned cushions with cells of different heights.

Graebe U.S. Pat. No. 5,111,544 shows a cover for a zoned cellular cushion which keeps the cells from deflecting outwardly. This cover has a stretchable top, a skid resistant base and a non-stretchable fabric side panel area.

One economic drawback to the air cell cushions is that they are fabricated from dipped neoprene rubber which is a costly process and the resultant cushion is expensive. The cost is justifiable in therapeutic situations, however a less costly alternative is desirable for other situations which are more concerned with prevention rather than curing ischemic ulcers and with the comfort of the user.

The present invention in its broadest sense comprises an expanded shaped soft foam base having a composite skin composed of a stretchable top cover layer and a water repellent inner layer applied thereto, and an air cell cushion having sealed air chambers positioned in a cavity beneath the top surface of the base at the area of the user's buttocks to prevent bottoming out of the user. The base of the cushion is covered with a neoprene rubber layer to retain the air cushion in the cavity and make the bottom of the base water impervious. The edges of the top cover skin and the bottom cover are secured by a binding around the periphery of the base.

SUMMARY OF THE INVENTION

It is a principal object of the present invention to provide a composite cushion having a soft foam base and a sealed cell air cushion beneath the top surface in a chamber at the user's buttocks area to prevent bottoming out of the user, with the entire cushion being encased is a moisture impervious skin which has a stretch characteristic over the top surface. Another object is to provide a method of making partly filled sealed air cells for the sealed air cell cushion, whereby the cushion is usable at a variety of altitudes, barometric pressures, and temperatures.

Still another object is to provide at a reduced cost a moisture impervious soft foam cushion having an air cushion with partially filled sealed air cells beneath the buttocks of the user to provide required support and force equalization beneath the ischia. These and other objects and advantages will become apparent hereinafter.

DESCRIPTION OF THE DRAWINGS

In the drawings wherein like numbers refer to like parts wherever they occur.

DETAILED DESCRIPTION

Figure 1:
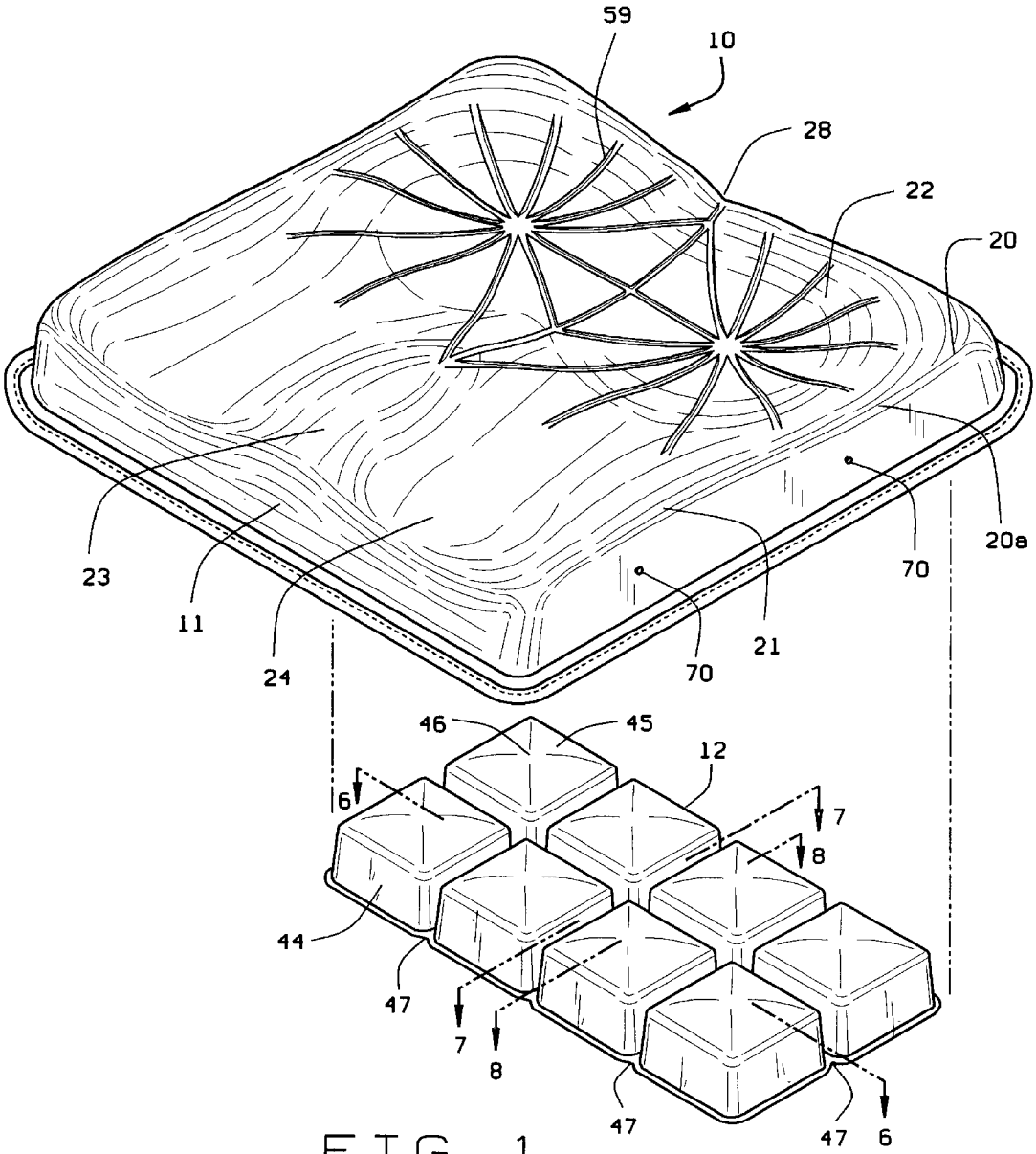
FIG. 1 is an exploded perspective view showing the foam cushion and the sealed cell air cushion.

FIGS. 1–5 show the cushion 10 of this invention which includes a base 11 and an air cell module 12 positioned inside the base 11 beneath the buttocks area of the user.

The base 11 is made from expanded polyurethane foam and is relatively soft but has sufficient rigidity when combined with the air cell module 12 to support the weight of the user. Integrally attached to the top and side surfaces of the base 11 during the molding process is a moisture resistant composite skin 13. The skin 13 is formed of a two-way stretch outer layer 14 and a moisture resistant inner layer 15. The composite skin 13 is sold under the trademark DARLEX and includes the stretch layer 14, which is a commercial material sold under the trademark SPANDEX, and the inner moisture impervious layer 15 which is a polyetherurethane. The smooth stretch layer 14 allows the cushion 10 to move under the weight of the user and allows the user to slide on and off the cushion 10 without undue friction. The moisture impervious layer 15 protects the foam base 11 from moisture, such as urine from an incontinent user. Moisture results in deterioration of the foam and consequently a shorter life for the cushion.

Figure 4:
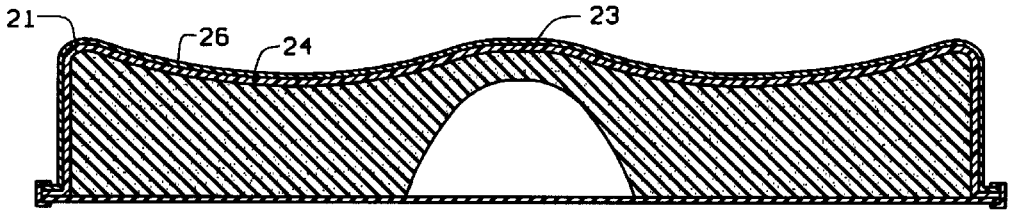
FIG. 4 is a sectional view taken along line 4—4 of FIG. 2.
Figure 5:
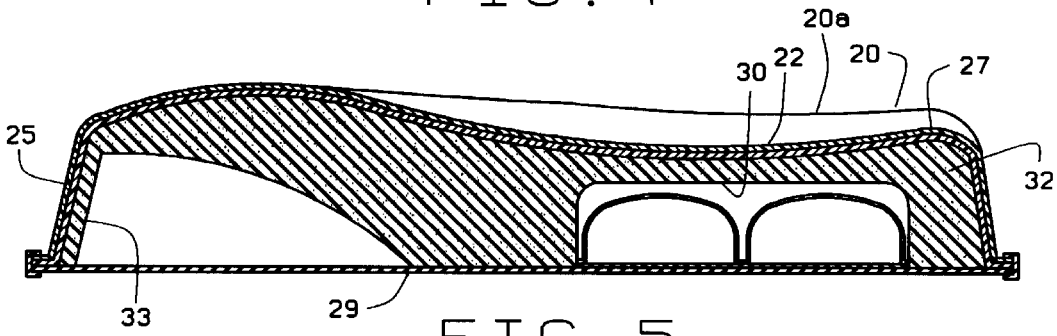
FIG. 5 is a sectional view taken along line 5—5 of FIG. 2.
Figure 6:
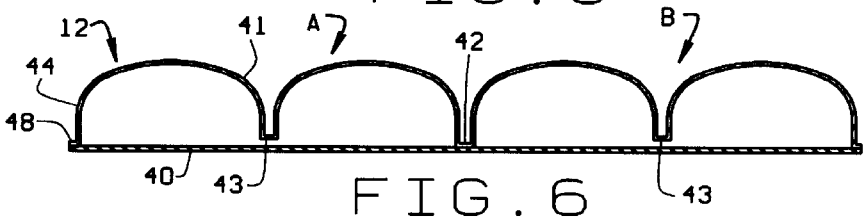
FIG. 6 is a sectional view taken along line 6—6 of FIG. 1.
Figure 7:
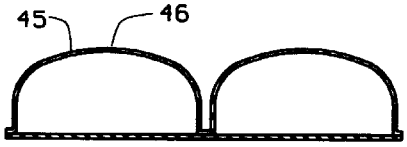
FIG. 7 is a sectional view taken along line 7—7 of FIG. 1.
Figure 8:
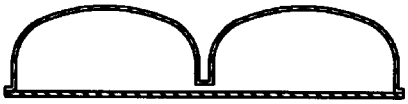
FIG. 8 is a sectional view taken along line 8—8 of FIG. 1.

The foam base 11 preferably is formed from open cell polyurethane and is soft enough to provide a comfortable feel to the user, but still has sufficient firmness and thickness to support the weight of the user when combined with the air module support beneath the ischia. The foam preferably has an IFD (indentation force deflection) of about 22 to about 28. As shown in FIGS. 1–5, the base 11 has a shaped top surface which includes rear side edges 20, designed along with raised front side edges 21 to relieve pressure on the trochanters of the user, and a rear depression 22 to accommodate the ischia of the user. The rear side edges 20 are lower than the front side edges 21 and have a reduced area 20*a* to provide trochanter relief. A raised pommel 23 with the front side edges 21 define leg troughs 24. The base 11 also includes a tapered front face 25 as seen in FIG. 5 and inwardly curved thigh loading areas 26 at the front side edges 21. The front face 25 slopes about 2°. The areas 26 are sloped inwardly from the outer side edges 21 to provide the proper thigh loading characteristics without providing too much pressure against the thighs. The raised pommel 23 which is about the same height as the side areas 21 is designed to separate the legs, stabilize the pelvis, and to help keep the user from sliding out of his seat. Between the raised side areas 21 and the pommel 23 are the dish shaped leg retaining valleys 24, which are slightly angularly inclined outwardly away from the center of the rear base area depression 22 so as to separate the legs in conjunction with the pommel 23. The base rear edge 27 is raised slightly to help retain the user in the seat. At the center is a reduced area 28 which provides relief for the coccyx of the user.

Figure 11:
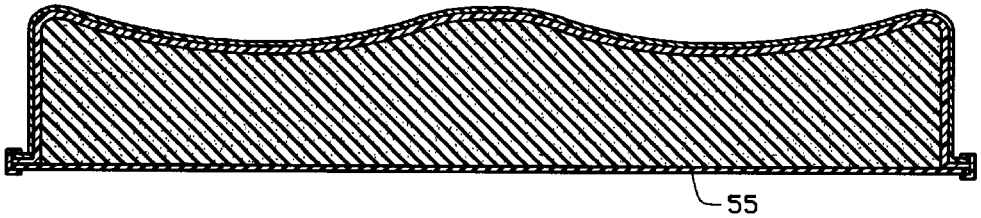
FIG. 11 is a sectional view similar to FIG. 4 but of a modification of this invention.
Figure 12:
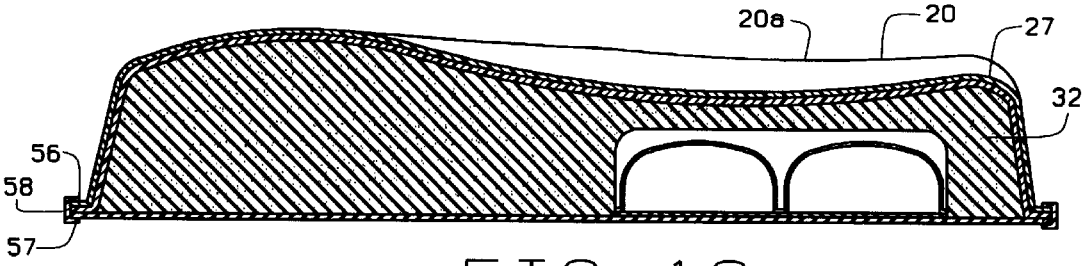
FIG. 12 is a sectional view similar to FIG. 5 but of the modification shown in FIG. 11.

The base 11 has formed in its bottom 29 a chamber 30 beneath the depression area 22. The chamber 30 is designed to accommodate the air cell module 12. The chamber 30 extends from the one rear side edge 20 to the other side edge 20 to define vertical side walls 31 and from the rear edge 27 less than one-half the distance to the front face 25 and defines a vertical rear wall 32. The base 11 also may have a hollowed out space 33 beneath the pommel 23 as shown in FIGS. 4 and 5. Preferably, however, the base is solid beneath the pommel 23 as shown in FIGS. 11 and 12.

The side walls 31 and the rear wall 32 are too soft and thin to prevent the user from bottoming out without some assistance. This is provided by the air module 12 which is positioned inside the rear chamber 30. The module 12 combined with the foam remaining in the rear of the base 11 prevents bottoming out of the user and also provides the desired feel, support and physiological properties required of a seat cushion.

The module 12 may be of the type described in Robert H. Graebe U. S. Pat. No. 5,369,828 entitled INFLATABLE CUSHION WITH UPSTANDING PYRAMIDAL AIR CELLS which is incorporated herein by reference as fully as if set out in its entirety.

The inflatable cushion or module 12 has a flexible base 40 of substantially rectangular shape and the air cells 41 project upwardly from the base 40. In the preferred embodiment there are two zones A and B which are distinct and separated by a center area 42. The air cells 41 in each of the zones A and B are interconnected by means of passages 43. Thus, the air pressure in the cells 41 in each zone is the same.

These passages 43 may be constructed as described in Graebe U.S. Pat. No. 4,541,136 or may be raised tunnels molded into the top member where the air cells 41 are formed.

As previously noted the module 12 is formed from preinflated cells 41. The modules 12 are prefilled at the factory with a predetermined air pressure and this pressure cannot be adjusted by the user. The cells 13 are interconnected within each zone A and B but the pressure in the zones A and B cannot be adjusted after once being established. As will be described in detail hereinafter, the cells 41 are only partially filled with air so that the cushion 10 is usable at a variety of altitudes. The two cell sets A and B are independent to avoid tilting a user too far to one side. If the user were to lean to one side on accessing the cushion 10, all of the air could go to the opposite side if all of the cells were interconnected. This could incline the user at a very undesirable angle. By keeping the sets A and B, separate the desired effect of equalizing load on the user's skin is achieved and the stability of the user is maintained as well.

The air cells 41 are of pyramidal shape and have a square bottom, rectangular side edges 44, tapered top sides 45 of trapezoidal or triangular shape, and a substantially rounded top 46. The purpose of the pyramid shape is to provide a means to collapse the air cell in a controlled manner during the engagement phase by the person sitting on the points formed by the pyramid. The higher the point the greater the engagement travel which gradually builds up the internal pressure of the cells giving a low force entry zone which is important when prefilled or sealed air cells are used. The air cells 41 are spaced from each other by lateral and longitudinal passages 47 and stand relatively independently of each other when erected and filled with air. The inflatable module 12 preferably is formed of a flexible material by vacuum forming or the like. The base 40 is sealed to the air cells 41 around the edges 48 of the module 12 and between the cells 41 (except for the passages 43) by R. F. welding or the like.

The base bottom 29 is sealed by a water impervious sheet 55, which preferably is of neoprene. The sheet 55 is glued to the base bottom 29 after the air cell module 12 has been placed in the chamber 30 and it retains the module 12 loose in the chamber 30.

The cushion skin 13 has a peripheral edge 56 which is slightly larger than the periphery of the foam base bottom 29. The bottom cover 55 also has an edge 57 which is slightly larger than the base bottom 29 and is co-extensive with the skin edge 56. A binding 58 covers the edges 57,58 and is sewn to the edges 57,58 to give a finished appearance to the cushion 10. The binding 58 also eliminates the possibility of a rough edge of the skin 13 or the bottom cover 55 engaging the legs of the user and possibly chaffing them.

Figure 2:
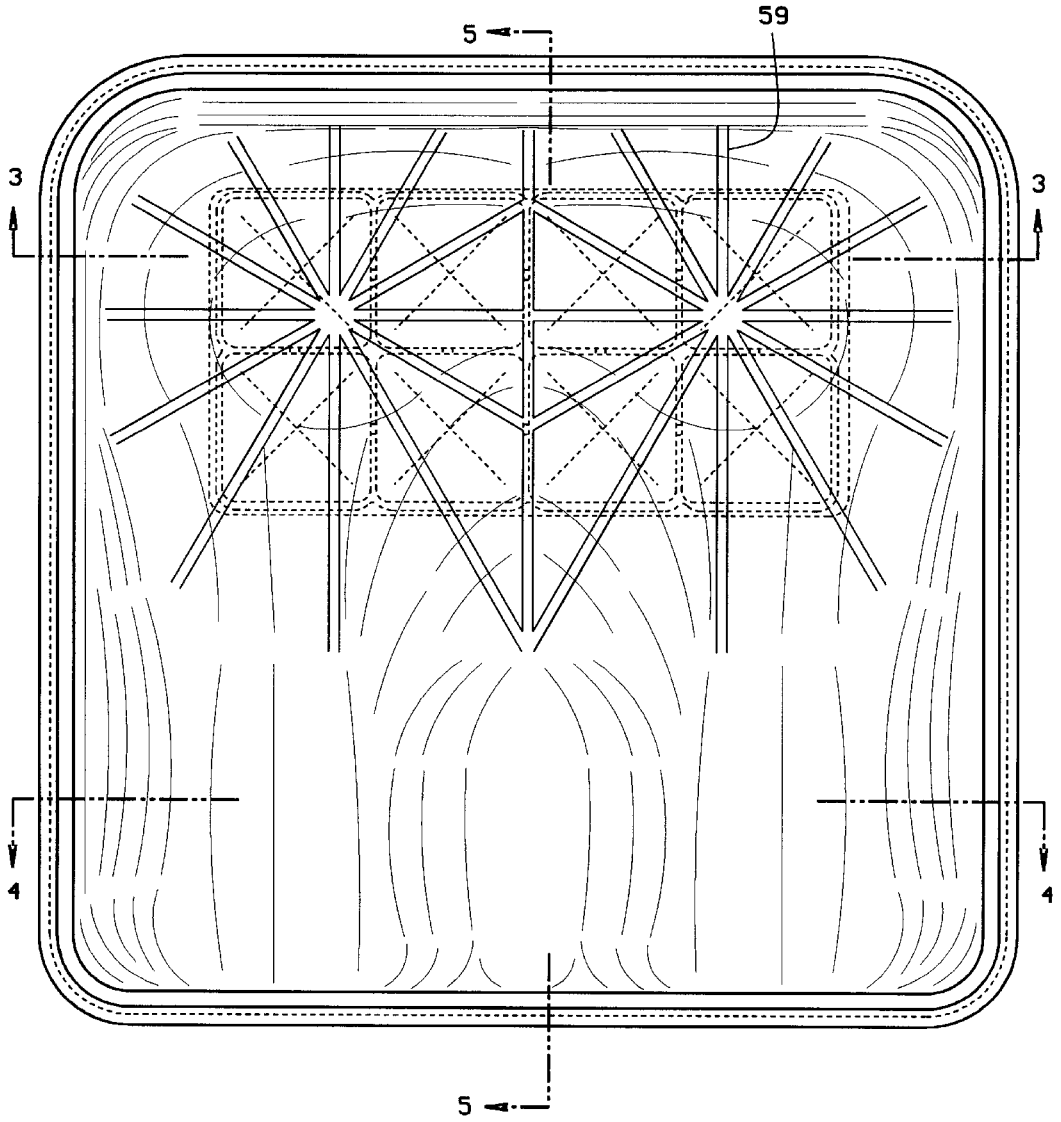
FIG. 2 is a top plan view of the cushion of FIG. 1.
Figure 3:
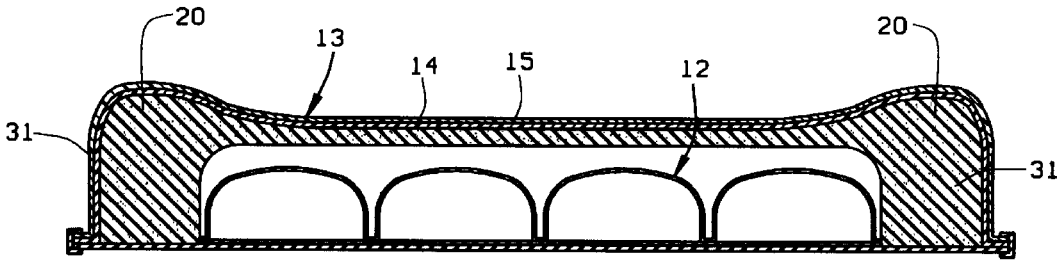
FIG. 3 is a sectional view taken on line 3—3 of FIG. 2.

The top surface of the foam base is formed with relief areas 59 shown in FIGS. 1 and 2 as a sunburst pattern, but any pattern is suitable. The purpose of the relief areas 59 is to provide space for air to circulate between the user and the cushion.

The cushion skin 13 has series of pin size openings 70 in the side walls to allow air to escape from the cushion, thus allowing the user to sink into the cushion and reach the air cell module 12. If these air escape openings were not present, the entire cushion would be a large air cell and be very unstable. The small size and limited number of openings does not significantly lessen or impair the moisture impermeability of the cushion.

Fabrication of Cushion And Air Cell Module

Figure 9:
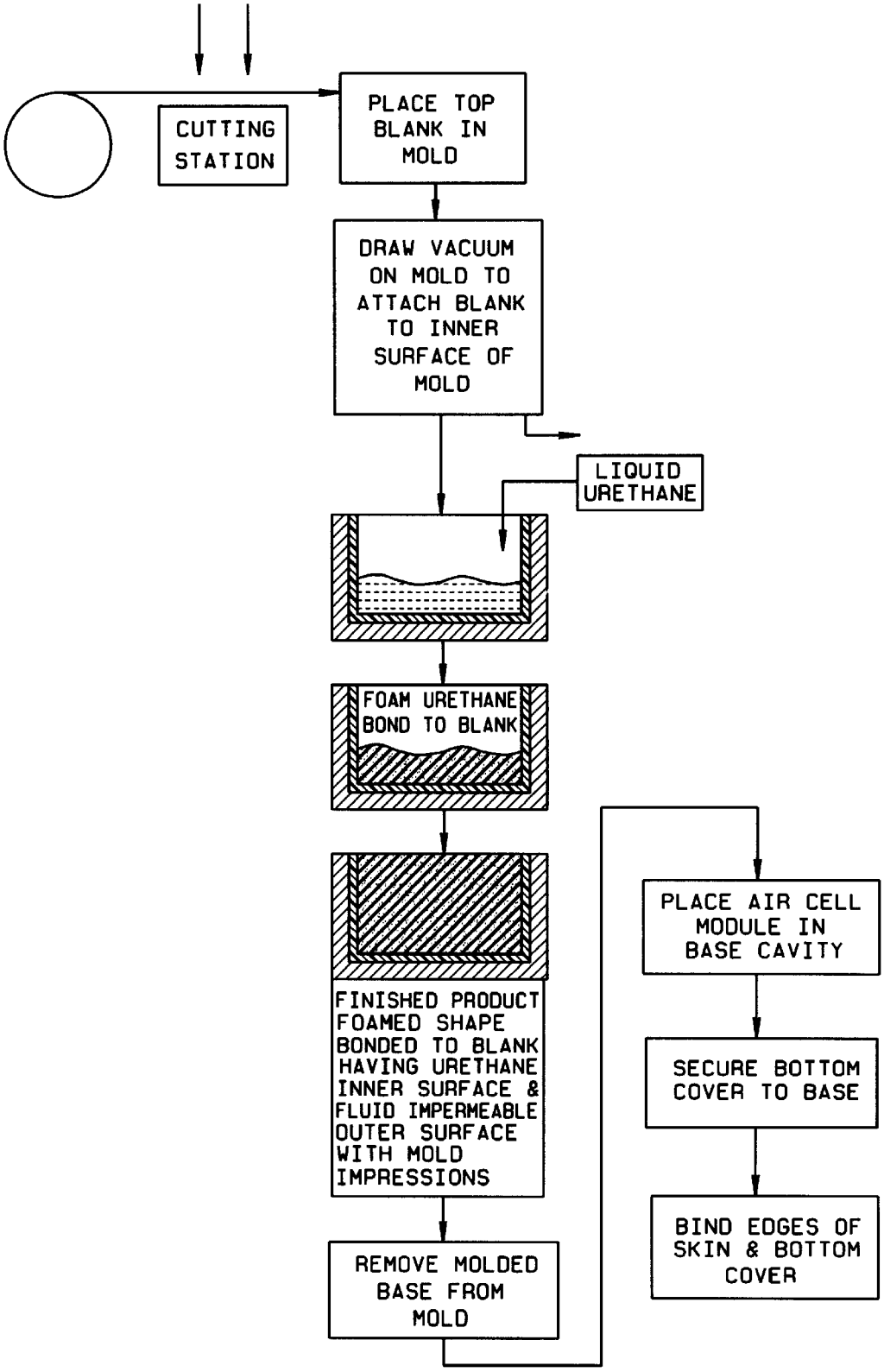
FIG. 9 is a schematic flow diagram of the process of making the cushion of this invention.

FIG. 9 shows schematically the steps in forming the cushion. By placing the skin inside the cushion mold, when the urethane is formed, it binds to and adheres the skin 13 to the base 11.

Figure 10:
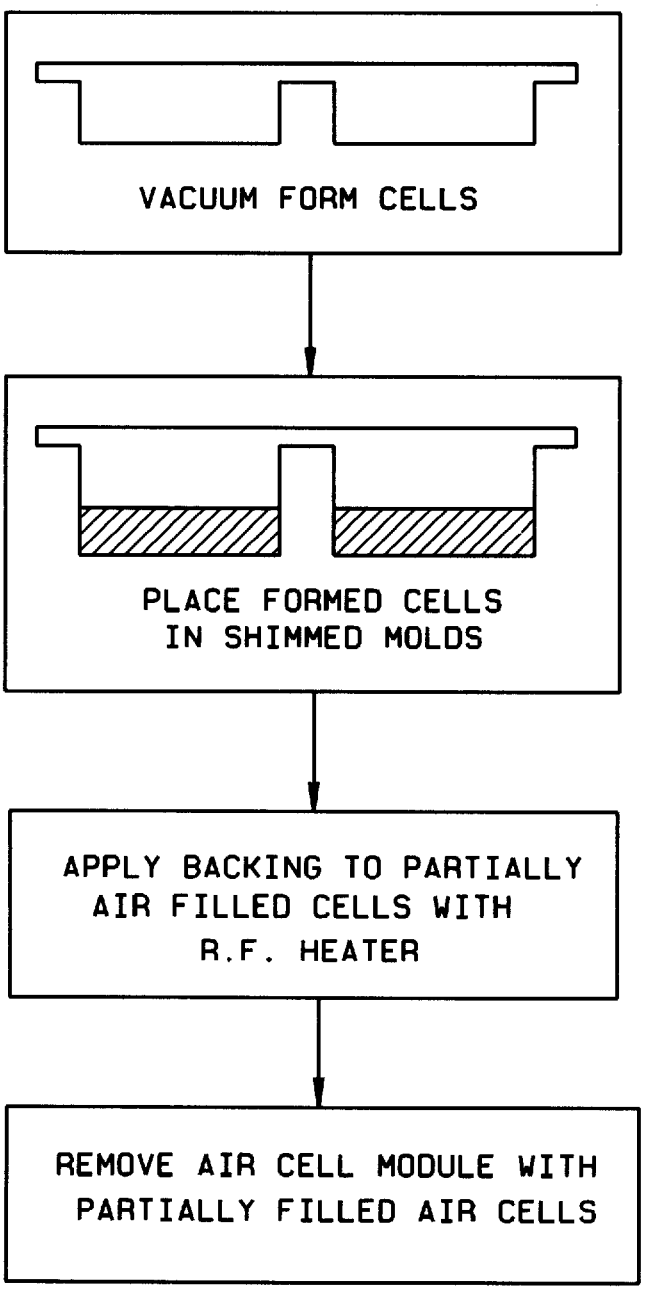
FIG. 10 is a schematic flow diagram of the process of making partially filled sealed air cells.

FIG. 10 shows the method of making the air cell module 12 with only partially filled cells 41. The air cells 41 are vacuum formed in a one piece top section with open cell bottoms. The top portion is removed from the mold and placed into a second mold that has cavities of the same outside dimensions but of reduced depth. This causes the cells 41 to be particle collapsed and not extended to their full capacity. The partially collapsed cells 41 thus hold less than their capacity of air. When the air cell module base 40 is applied to the air cells 41 (when the air cells 41 are still in the smaller molds) the amount of air trapped in the cells 41 is less than their capacity. The reason for doing this is to make the air cell module usable at a variety of altitudes, barometric pressures, and atmospheric temperatures from sea level to about 7,000 feet. When the cushion is used at higher altitudes, the air pressure is reduced and the air trapped in the cushion expands to inflate the air cells 41. This makes their surfaces harder and less comfortable to the user.

This invention is intended to cover all changes and modifications of the example of the invention herein chosen for purposes of the disclosure which do not constitute departures from the spirit and scope of the invention.

What is claimed is:

1. A cushion comprising an expanded foam base having a contoured top surface to accommodate a person in a seated position thereon and provided with a hollowed out chamber in the bottom surface positioned beneath the rear portion of the top surface and beneath the buttocks of a person positioned on the top surface, the chamber defined in part by rear and side walls, the said rear and side walls being too soft and thin to prevent the user from bottoming out when seated on the cushion, a separate independent sealed air cell module loosely positioned in the chamber, the air cell module comprising a flexible base and flexible upstanding air cells, at least some of which are pneumatically interconnected, and a cover positioned on the base bottom surface over the chamber to retain the air cell module loosely in the chamber and restrict access to the air cell module.

2. The cushion of claim 1 wherein the base bottom is smooth and free of protruding elements.

3. The cushion of claim 1 wherein the top surface of the base is covered by a moisture resistant cover.

4. The cushion of claim 3 wherein the cover has a stretchable outer layer and a moisture resistant inner layer bonded thereto, the inner layer being bonded to the foam base.

5. The cushion of claim 3 wherein the cover over the bottom surface retaining the air cell module in the hollowed out area is moisture impervious.

6. The cushion of claim 5 wherein the moisture resistant cover has a plurality of small openings for allowing air to pass from the base to atmosphere when a user sits on the cushion thereby allowing the user to sink into the cushion and reach the air cell module.

7. The cushion of claim 5 including a tape positioned around the periphery of the bottom edge of the base binding the peripheral edges of the top cover and the bottom cover.

8. The cushion of claim 1 wherein the top surface of the foam base includes a front area having a raised center pommel area and raised side areas to define spaced troughs for the legs of the user.

9. The cushion of claim 8 wherein the forward edge of the top front area inclines slightly downwardly to facilitate the user sliding off of the cushion.

10. The cushion of claim 8 including a second hollowed out area beneath the center pommel to soften the cushion beneath the genital area of the user.

11. The cushion of claim 1 wherein the top surface rear portion has a lateral depression area to receive the buttocks of the user.

12. The cushion of claim 11 wherein the top surface of the cushion in the depression area is provided with reduced areas to provide air circulation beneath the buttocks of the user.

13. The cushion of claim 11 wherein the depression area is surrounded by raised rear and side rims, the rear rim having a central depressed area to accommodate the coccyx of the user, and the side rims having reduced areas to relieve the trochanter areas.

14. The cushion of claim 1 wherein the rear hollowed out area is defined by side walls and a rear wall, the side walls being wider and more rigid than the rear wall.

15. The cushion of claim 1 wherein the air cells are filled to less than their maximum volume with air.

16. The cushion of claim 15 wherein the air cells are filled to about five-sevenths of their maximum volume with air.

17. The cushion of claim 1 wherein the air cell module is made from polyesterurethane having high resistance to air permeability.

18. A cushion comprising an expanded foam base having a contoured top surface to accommodate a person in a seated position thereon and provided with at least one hollowed out area in the bottom surface, the hollowed out area being positioned beneath the rear portion of the top surface and beneath the buttocks area of a person positioned on the top surface, and an air cell module positioned in the said hollowed out area, the air cell module comprising a bottom wall and an upstanding air cell area comprising a series of independent upstanding air cells and having flexible top and side walls, the air cell area being filled with air to provide flexible support for the user's buttocks.

19. The cushion of claim 18 wherein the air cells are formed in two pneumatically independent side-by-side sets and air cells in each set are interconnected by restricted passages positioned at the bottom wall.

20. The cushion of claim 18 wherein the air cells have rectangular bases and pyramidal tops.

21. The cushion of claim 18 wherein the air cell module is sealed to retain the air in the module.

22. The method of making a sealed cell cushion which is usable over a wide variety of atmospheric pressures comprising the steps of:

a) forming a series of air cells in a first flexible sheet of plastic air impermeable material, b) placing the first sheet of air cells in a mold having mold cells aligned with the preformed cells in the sheet, but the mold cells being of lesser size than the preformed cells, c) placing a second backing sheet of compatible plastic material over the first plastic sheet, d) securing the second sheet to the first sheet around the base of the cells to seal the air in the cells to form a sealed cell cushion, and e) removing the sealed cell cushion from the mold whereby the air trapped in the cells is less than the maximum volume of the cells and can expand as the cushion is transported to an area of lesser air pressure.

23. The cushion of claim 21 wherein the air cells are filled to less than their maximum volume with air.

* * * * *